US010358994B1

(12) United States Patent
Dudar

(10) Patent No.: US 10,358,994 B1
(45) Date of Patent: Jul. 23, 2019

(54) METHOD AND SYSTEM FOR ENGINE CONTROL

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/863,515

(22) Filed: Jan. 5, 2018

(51) Int. Cl.

| | |
|---|---|
| ***F02D 41/06*** | (2006.01) |
| ***F02P 23/04*** | (2006.01) |
| ***F02N 11/08*** | (2006.01) |
| ***F02D 43/04*** | (2006.01) |

(52) U.S. Cl.
CPC ..... *F02D 41/062* (2013.01); *F02D 43/04* (2013.01); *F02N 11/0848* (2013.01); *F02P 23/04* (2013.01); *F02N 2250/06* (2013.01)

(58) Field of Classification Search
CPC ..... F02D 41/003; F02D 41/004; F02D 41/06–065; F02D 41/22; F02D 41/221; F02D 41/123; F02D 41/0087; F02D 43/04; F02D 2041/0092; F02D 2041/228; F02N 11/08; F02N 11/0848; F02P 23/04; F02P 11/00–002; F02P 11/06
USPC ..... 123/179.15, 179.18, 179.16, 179.3, 123/406.13, 406.14, 406.27, 518–520, 123/625, 630, 196 S, 198 D, 198 DB, 123/198 F; 701/102, 107, 111, 113, 115
See application file for complete search history.

(56) References Cited

U.S. PATENT DOCUMENTS

| | | | | |
|---|---|---|---|---|
| 5,485,814 | A * | 1/1996 | Tuggle | B27B 17/00 123/179.18 |
| 7,404,395 | B2 | 7/2008 | Yoshimoto | |
| 7,523,744 | B2 * | 4/2009 | Ayame | F02D 41/0025 123/1 A |
| 8,042,510 | B2 | 10/2011 | Martin et al. | |
| 8,297,248 | B2 | 10/2012 | Martin et al. | |
| 8,616,006 | B2 * | 12/2013 | Rocci Denis | F02C 7/24 60/39.821 |
| 9,109,525 | B2 | 8/2015 | Martin et al. | |
| 2011/0180030 | A1 * | 7/2011 | Martin | F02D 41/06 123/143 B |
| 2011/0288746 | A1 * | 11/2011 | Carr | F02D 41/0025 701/103 |
| 2013/0133618 | A1 * | 5/2013 | Larsson | F02D 41/065 123/438 |

(Continued)

OTHER PUBLICATIONS

Miller, K. et al., "Efficiency Enhancement to a Laser Ignition System," U.S. Appl. No. 15/280,752, filed Sep. 29, 2016, 41 pages.

(Continued)

*Primary Examiner* — Hung Q Nguyen
*Assistant Examiner* — Johnny H Hoang
(74) *Attorney, Agent, or Firm* — Julia Voutyras; McCoy Russell LLP

(57) ABSTRACT

Methods and systems are provided for drying engine cylinders in situ responsive to engine flooding. In one example, a laser ignition device is operated in each engine cylinder, sequentially, while the cylinder is parked with an intake valve closed and an exhaust valve open. The heat generated by the laser operation vaporizes liquid fuel in the cylinder, which flows out of the cylinder via the open exhaust valve, expediting cylinder drying.

20 Claims, 4 Drawing Sheets

(56) References Cited

U.S. PATENT DOCUMENTS

| | | | | |
|---|---|---|---|---|
| 2014/0288808 | A1* | 9/2014 | Glugla | F02D 33/006 701/113 |
| 2017/0037796 | A1* | 2/2017 | Collie | F02D 41/0025 |
| 2017/0204796 | A1* | 7/2017 | Dudar | F02D 41/0035 |

OTHER PUBLICATIONS

Dudar, A., "System and Method for Mitigating Wet-Fouling of Spark Plugs," U.S. Appl. No. 15/809,017, filed Nov. 10, 2017, 109 pages.

* cited by examiner

METHOD AND SYSTEM FOR ENGINE CONTROL

FIELD

The present description relates generally to methods and systems for addressing engine flooding.

BACKGROUND/SUMMARY

Engine ignition systems may include a spark plug for delivering an electric current to a combustion chamber of a spark-ignited engine, such as a gasoline engine, to ignite an air-fuel mixture and initiate combustion. Spark plug fouling may occur wherein a firing tip of the spark plug insulator becomes coated with a foreign substance, such as fuel or soot. Soot-fouled spark plugs include a carbon build-up on an electrode of the spark plug, whereas wet-fouled spark plugs include liquid fuel build-up around the electrode. Spark plugs may become wet-fouled due to engine flooding, for example. The engine may flood due to rich fueling during extreme temperature weather conditions, when an operator depresses/pumps the gas pedal repeatedly during cranking, or due to excess fuel inside the cylinders (e.g., due to a degraded fuel injector). When the spark plugs become wet-fouled, they are unable to produce a spark across the electrode, thus delaying or preventing engine start. Engine flooding may also affect other in-cylinder components and delay engine start when the cylinder includes other forms of ignition. In some instances, engine flooding may cause a frustrated vehicle operator to continue cranking the engine until the battery drains. Further, vehicle emissions may be increased due to repeated unsuccessful cranks while the engine is flooded.

Common services remedies to address engine flooding include removing the spark plugs and drying them with compressed shop air or a heat gun. Still other remedies include leaving the engine to sit for a while to allow the fuel inside the cylinders to vaporize. However, such approaches are intrusive and/or time consuming. In addition, vehicle operators may not be able to start the engine when requested.

Other attempts to address spark plug wet-fouling in a less intrusive manner include methods for removing fuel adhered to the spark plug while the spark plug remains in the engine. One example approach is shown by Ayame et al. in U.S. Pat. No. 7,523,744 B2. Therein, a method is disclosed that cranks the engine without injecting additional fuel in response to an indication that the engine has not started properly (e.g., within a duration of beginning the cranking).

However, the inventor herein has recognized potential issues with such systems. As one example, cranking the engine without providing additional airflow to dry the spark plugs (or other flooded cylinder components) may be inefficient, resulting in increased engine starting times. The increased engine starting times may increase vehicle operator frustration as well as drain the battery. In addition, tailpipe emissions may be increased with repeated and unsuccessful cranking of the flooded engine. Still other approaches may rely on an electric booster to blow air into engine cylinders while spinning the engine unfueled to dry the spark plugs. However, such approaches may be limited to vehicle systems configured with an electric booster.

In one example, the issues described above may be addressed by a method comprising: in response to flooding of an engine with fuel during an engine start attempt, shutting off fuel delivery to an engine cylinder and operating a laser ignition device to vaporize the fuel while holding an exhaust valve of the cylinder open and an intake valve of the cylinder closed. In this way, a flooded combustion chamber may be dried efficiently and non-intrusively.

As one example, an engine system may be configured with laser ignition. If a controller determines engine flooding has occurred during an engine start (such as responsive to a lack of engine start following cranking, and/or based on rich UEGO sensor output during the start), a drying routine may be initiated. Therein, the engine may be spun, unfueled via a motor, to park a first engine cylinder at a position where an intake valve is closed and an exhaust valve is open (such as at a top of the exhaust stroke). Then, while the engine is held at that position, a laser igniter may be operated for a duration to vaporize liquid fuel in the cylinder. If the laser is maneuverable, a beam direction and focal point may be adjusted on different regions of the cylinder (e.g., at random or targeted) so as to vaporize fuel throughout the cylinder. Since the exhaust valve is open, the vaporized fuel is directed out of the cylinder and into the exhaust passage, resulting in a rapid and efficient drying of the given cylinder. The engine is then rotated by the motor to park a second engine cylinder at a position with the intake valve closed and the exhaust valve open, and laser operation is used to dry this cylinder. In the same way, all engine cylinders may be sequentially dried. Thereafter, an engine start may be reinitiated.

In this way, engine flooding may be addressed without requiring removal of cylinder components or additional hardware. By drying the engine using heat generated via a laser igniter coupled to the cylinder, engine starting times may be decreased and reproducibility of engine starts is improved. Further, battery consumption may be decreased. Overall, wet-fouled cylinder components may be dried faster. By improving the quality of engine starts, vehicle operator frustration is reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
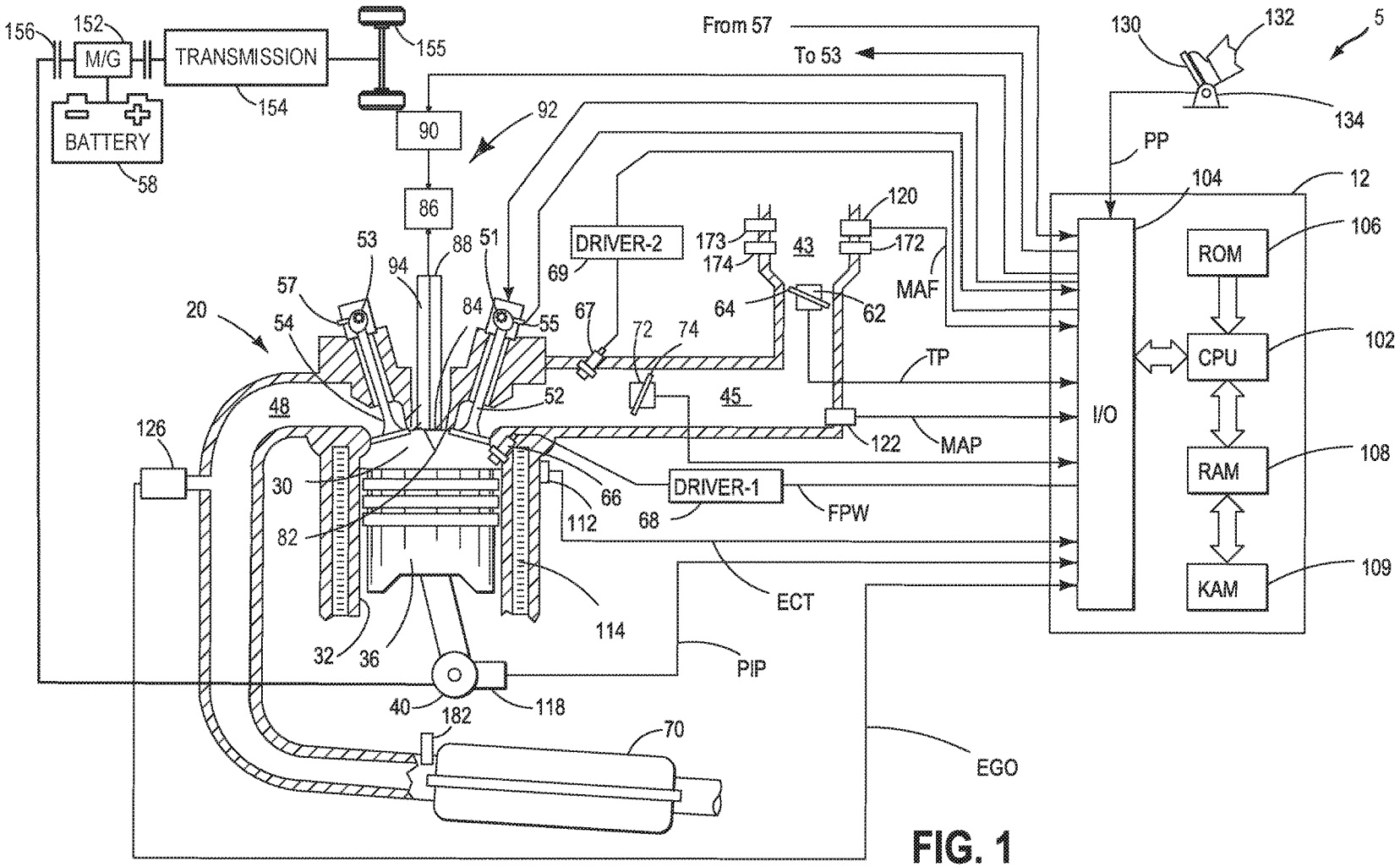
FIG. 1 shows a schematic depiction of an example vehicle system having an engine configured with laser ignition.

The following description relates to systems and methods for mitigating engine flooding and associated wet-fouling of cylinder components in an engine system configured with laser ignition, such as the engine system shown in FIG. 1. In response to an indication of engine flooding, a controller may perform a control routine, such as the example routine of FIG. 2, to dry engine cylinders using heat generated via operation of a laser igniter. The controller may operate the laser igniter after parking each cylinder, sequentially, in a position where an intake valve is closed and an exhaust valve is open, as shown with reference to FIG. 3, so that the vaporized fuel can be flowed out of the cylinder into the exhaust system. An example drying operation is shown with reference to FIG. 4.

Turning to FIG. 1, an example hybrid propulsion system 10 is depicted. The hybrid propulsion system may be configured in a passenger on-road vehicle, such as hybrid electric vehicle 5. Hybrid propulsion system 10 includes an internal combustion engine 20. Engine 20 may be a multi-cylinder internal combustion engine, one cylinder of which is depicted in detail at FIG. 1. Engine 20 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion cylinder 30 of engine 20 may include combustion cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of propulsion system 10 via an intermediate transmission system. Combustion cylinder 30 may receive intake air from intake manifold 45 via intake passage 43 and may exhaust combustion gases via exhaust passage 48. Intake manifold 45 and exhaust passage 48 can selectively communicate with combustion cylinder 30 via respective intake valve 52 and exhaust valve 54. In some embodiments, combustion cylinder 30 may include two or more intake valves and/or two or more exhaust valves.

In the example shown, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. To enable detection of cam position, cam actuation systems 51 and 53 may have toothed wheels. The position of intake valve 52 and exhaust valve 54 may be determined by cam position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion cylinder 30 for injecting fuel directly therein in proportion to the pulse width of signal FPW received from controller 12 via electronic driver 68. In this manner, fuel injector 66 provides what is known as direct injection of fuel into combustion cylinder 30. The fuel injector may be mounted on the side of the combustion cylinder or in the top of the combustion cylinder, for example. Fuel may be delivered to fuel injector 66 by a fuel delivery system (not shown) including a fuel tank, a fuel pump, and a fuel rail. Fuel injector 67 is shown arranged in intake passage 43 in a configuration that provides what is known as port injection of fuel into the intake port upstream of combustion cylinder 30. Fuel injector 67 delivers fuel into the intake port in proportion to the pulse width of signal FPW-2 received from controller 12 via electronic driver 69. In this manner, fuel injector 67 provides what is known as port injection of fuel into combustion cylinder 30.

Intake passage 43 may include a charge motion control valve (CMCV) 74 and a CMCV plate 72 in addition to a throttle 62 having a throttle plate 64. In this particular example, the position of throttle plate 64 may be varied by controller 12 via a signal (TP) provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 43 may include a mass air flow sensor 120 and a manifold air pressure sensor 122 for providing respective signals MAF and MAP to controller 12.

Intake passage 43 may also include one or more temperature and/or pressure sensors for estimating ambient conditions. For example, intake passage 43 may include an intake air temperature (IAT) sensor 172 for estimating a temperature of intake air drawn into the intake manifold and thereon into engine cylinders. Intake passage 43 may further include a barometric pressure sensor 173 for estimating ambient pressure, and a humidity sensor 174 for estimating ambient humidity. During engine operation, one or more engine operating parameters may be adjusted based on the ambient temperature, pressure, and/or humidity, such as throttle position, engine dilution, valve timing, etc. As elaborated herein, during selected key-off conditions, intake air temperature sensor 172 may also be used for diagnosing a cylinder laser ignition system.

Exhaust gas sensor 126 is shown coupled to exhaust passage 48 upstream of an emission control device 70. Emission control device (ECD) 70 may include one or more catalytic converters and particulate matter filters. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_R$, HC, or CO sensor. The exhaust system may include light-off catalysts and underbody catalysts, as well as exhaust manifold, upstream and/or downstream air/fuel ratio sensors. ECD 70 can include multiple catalyst bricks, in one example. In another example, multiple emission control devices, each with multiple bricks, can be used. ECD 70 can be a three-way type catalyst in one example.

In still further example, ECD 70 may include a particulate matter filter for retaining particulate matter (PM) emissions, such as soot and ash, from exhaust gas, before the gas is released to the atmosphere via a tailpipe. The filter may include one or more temperature and/or pressure sensors, such as temperature sensor 182, for estimating a PM load on the filter. The sensor may be coupled to the filter or multiple sensors may be coupled across the filter. For example, the PM load may be inferred based on a pressure or temperature differential across the filter. As elaborated herein, during selected key-off conditions, temperature sensor 182 may also be used for diagnosing a cylinder laser ignition system.

Controller 12 is shown in FIG. 1 as a microcomputer, including microprocessor unit 102, input/output ports 104, an electronic storage medium for executable programs and calibration values shown as read-only memory chip 106 in this particular example, random access memory 108, keep alive memory 109, and a data bus. The controller 12 may receive various signals and information from sensors coupled to engine 20, in addition to those signals previously discussed, including measurement of inducted mass air flow (MAF) from mass air flow sensor 120; engine coolant temperature (ECT) from temperature sensor 112 coupled to cooling sleeve 114; in some examples, a profile ignition pickup signal (PIP) from Hall effect sensor 118 (or other type) coupled to crankshaft 40 may be optionally included; throttle position (TP) from a throttle position sensor; and absolute manifold pressure signal, MAP, from sensor 122. The Hall effect sensor 118 may optionally be included in engine 20 because it functions in a capacity similar to the engine laser system described herein. Storage medium read-only memory 106 can be programmed with computer readable data representing instructions executable by processor 102 for performing the methods described below as well as variations thereof.

Engine 20 further includes a laser ignition system 92 for igniting an air-fuel mixture in cylinder 30. Laser ignition system 92 includes a laser exciter 88 and a laser control unit (LCU) 90. LCU 90 causes laser exciter 88 to generate laser energy. LCU 90 may receive operational instructions from controller 12. Laser exciter 88 includes a laser oscillating portion 86 and a light converging portion 84. The light converging portion 84 converges laser light generated by the laser oscillating portion 86 on a laser focal point 82 of combustion cylinder 30. In one example, light converging portion 84 may include one or more lenses.

A photodetector 94 may be located in the top of cylinder 30 as part of laser system 92 and may receive return pulses from the top surface of piston 36. Photodetector 94 may include a camera with a lens. In one example, the camera is a charge coupled device (CCD). The CCD camera may be configured to detect and read laser pulses emitted by LCU 90. In one example, when the LCU emits laser pulses in an infra-red frequency range, the CCD camera may operate and receive the pulses in the infra-red frequency range. In such an embodiment, the camera may also be referred to as an infrared camera. In other embodiments, the camera may be a full-spectrum CCD camera that is capable of operating in a visual spectrum as well as the infra-red spectrum. The camera may include a lens, such as a fish-eye lens, for focusing the detected laser pulses and generating an image of the interior of the cylinder. After laser emission from LCU 90, the laser sweeps within the interior region of cylinder 30. In one example, during cylinder laser ignition as well as during conditions when a cylinder piston position is to be determined, the laser may sweep the interior region of the cylinder at laser focal point 82. Light energy that is reflected off of piston 36 may be detected by the camera in photodetector 94.

It will be appreciated that while laser system 92 is shown mounted to a top of the cylinder, in alternate examples, the laser system may be configured with the laser exciter mounted on the side of the cylinder, substantially facing the valves.

Laser system 92 is configured to operate in more than one capacity with the timing and output of each operation based on engine position of a four-stroke combustion cycle. For example, laser energy may be utilized for igniting an air/fuel mixture during a power stroke of the engine, including during engine cranking, engine warm-up operation, and warmed-up engine operation. Fuel injected by fuel injector 66 may form an air/fuel mixture during at least a portion of an intake stroke, where igniting of the air/fuel mixture with laser energy generated by laser exciter 88 commences combustion of the otherwise non-combustible air/fuel mixture and drives piston 36 downward. Furthermore, light generated during the cylinder combustion event may be used by photodetector 94 for capturing images of an interior of the cylinder and assessing progress of the combustion event (e.g., for monitoring flame front progression).

In a second operating capacity, LCU 90 may deliver low powered pulses to the cylinder. The low powered pulses may be used to determine piston and valve position during the four-stroke combustion cycle. In addition, upon reactivating an engine from idle-stop conditions, laser energy may be utilized to monitor the position, velocity, etc. of the engine in order to synchronize fuel delivery and valve timing. Furthermore, light generated by the laser light pulse emission at the lower power may be used for capturing images of an interior of the cylinder before a cylinder combustion event occurs, such as during an intake stroke.

Controller 12 controls LCU 90 and has non-transitory computer readable storage medium including code to adjust the power output and location of laser energy delivery. Laser energy may be directed at different locations within cylinder 30. Controller 12 may also incorporate additional or alternative sensors for determining the operational mode of engine 20, including additional temperature sensors, pressure sensors, torque sensors as well as sensors that detect engine rotational speed, air amount and fuel injection quantity.

As described above, FIG. 1 shows one cylinder of multi-cylinder engine 20, and each cylinder may similarly include its own set of intake/exhaust valves, fuel injector, laser ignition system, etc.

During selected conditions, the engine may flood and wet-foul the cylinder, the ignitor, and other in-cylinder components. For example, the engine may flood due to rich fueling during extreme temperature weather conditions, when an operator depresses/pumps the gas pedal repeatedly during cranking. As another example, the engine may flood due to a leaky fuel injector causing excess fuel to accumulate inside the cylinders. Engine flooding can render the ignition of fuel difficult, thus delaying or preventing engine start. In some instances, a frustrated vehicle operator can continue to crank the engine causing the battery to drain, and/or further pump the gas pedal, causing additional engine flooding. In addition, vehicle emissions can degrade due to repeated unsuccessful cranks while the engine is flooded. As elaborated with reference to FIG. 2, responsive to an indication of engine flooding (such as following an unsuccessful engine start), a controller may initiate a drying routine wherein the laser igniter is used to generate heat in the cylinder to vaporize liquid fuel and flow the fuel vapors out of the cylinder. By operating the laser in each cylinder sequentially, each cylinder may be effectively dried, enabling a subsequent successful engine start.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 152. Electric machine 152 may be a motor or a motor/generator. Crankshaft 40 of engine 10 and electric machine 152 are connected via a transmission 154 to vehicle wheels 155 when one or more clutches 156 are engaged. In the depicted example, a first clutch 156 is provided between crankshaft 40 and electric machine 152, and a second clutch 156 is provided between electric machine 152 and transmission 154. Controller 12 may send a signal to an actuator of each clutch 156 to engage or disengage the clutch, so as to connect or disconnect crankshaft 140 from electric machine 152 and the components connected thereto, and/or connect or disconnect electric machine 152 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 152 receives electrical power from a traction battery 58 to provide torque to vehicle wheels 155. Electric machine 152 may also be operated as a generator to provide electrical power to charge battery 58, for example during a braking operation.

The controller 12 receives signals from the various sensors of FIG. 1 and employs the various actuators of FIG. 1 to adjust engine and vehicle operation based on the received signals and instructions stored on a memory of the controller. For example, responsive to an indication of engine flowing, such as based on exhaust oxygen sensor 126, the controller may operate laser exciter 88 (herein also referred to as the laser igniter) for a duration while the engine is at rest to generate heat to vaporize liquid fuel from a corresponding cylinder.

In this way, the components of FIG. 1 enables a vehicle system comprising: an engine including a plurality of cylinders, each of the plurality of cylinders including a corresponding laser ignition device, and fuel injector; an intake passage including an intake throttle, the throttle coupled to a throttle position sensor; an exhaust passage including an exhaust gas air-fuel ratio sensor; an electric motor; and a controller with computer readable instructions stored on non-transitory memory for: responsive to an unsuccessful engine start attempt, indicating engine flooding based on intake throttle position and air-fuel ratio sensor output during the unsuccessful engine start attempt; and responsive to the indication of engine flooding, disabling engine fueling, and sequentially drying each of the plurality of cylinders via operation of the laser ignition device while holding a corresponding cylinder at an exhaust stroke TDC position. In one example, holding the corresponding cylinder at an exhaust stroke TDC position includes rotating the unfueled engine via the electric motor to sequentially hold the corresponding cylinder at the exhaust stroke TDC position. The electric motor may be one of a starter motor coupled to the engine, and a propulsion motor coupled a driveline of the vehicle system. Operating the laser ignition device may include operating at a higher power setting than used for piston position determination. Additionally, the controller may include further instructions for restarting the engine after drying each of the plurality of cylinders.

Figure 2:
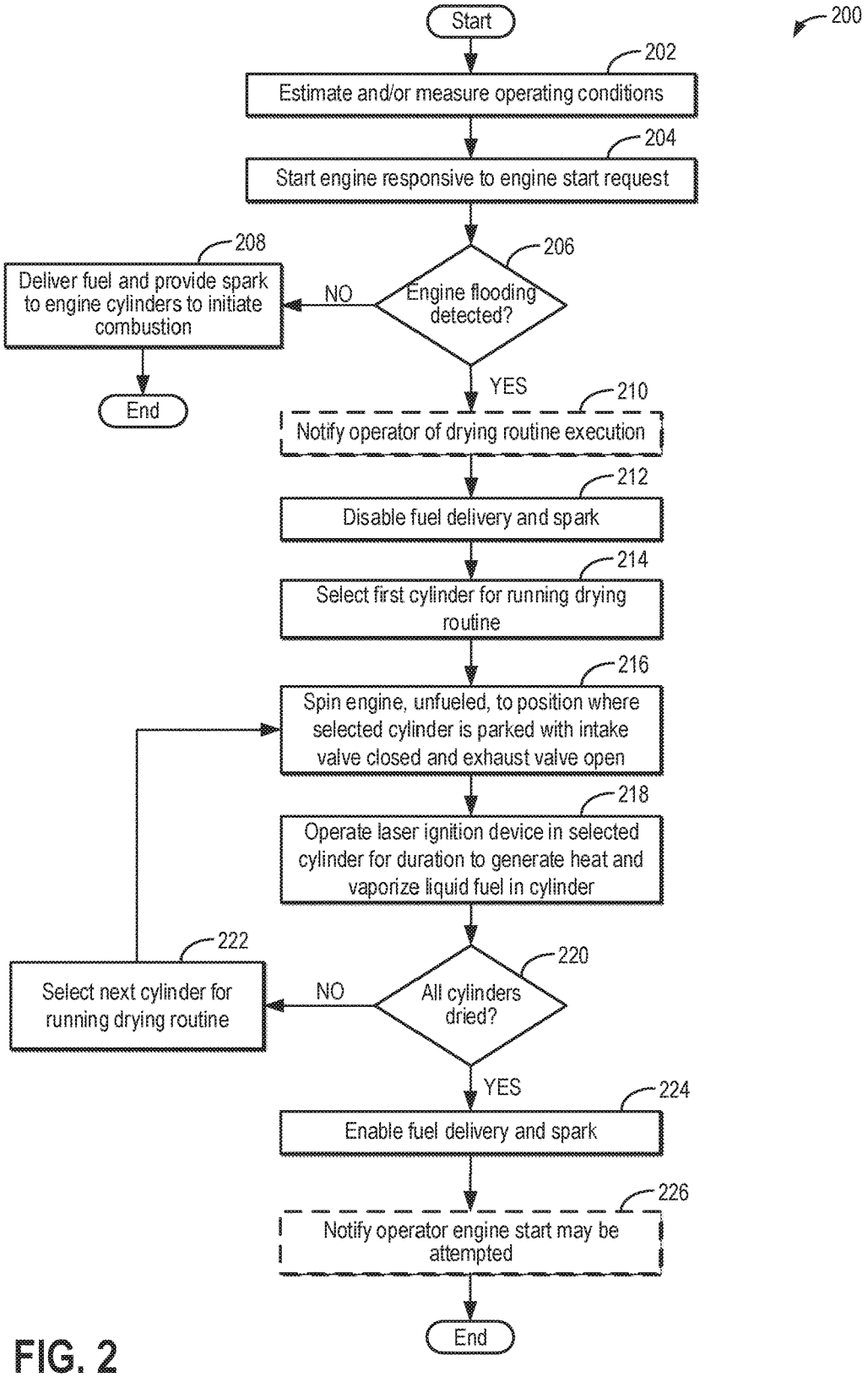
FIG. 2 depicts a high-level flow chart of an example method for addressing engine flooding by using a laser igniter to generate heat in engine cylinders.

FIG. 2 shows an example method 200 for detecting engine flooding and the presence of wet-fouling of cylinder components in an engine system and, in response thereto, drying the engine using heat generated via a laser ignition system. For example, method 200 may be executed during an engine start attempt so that engine flooding may be detected during the engine start attempt, and the engine cylinders may be subsequently dried before reattempting another engine start. Instructions for carrying out method 200 and the rest of the methods included herein may be executed by a controller (e.g., controller 12 of FIG. 1) based on instructions stored on a memory of the controller and in conjunction with signals received from sensors of the engine system, such as the sensors described above with reference to FIG. 1 (e.g., exhaust gas sensor 126 of FIG. 1). The controller may employ actuators of the engine system (e.g., laser exciter 88, fuel injector 66, intake valve actuator 52, and exhaust valve actuator 54 of FIG. 1) to adjust engine operation according to the methods described below.

Method 200 begins at 202 and includes estimating and/or measuring operating conditions. Operating conditions may include, for example, ambient temperature, ambient pressure, ambient humidity, throttle position (e.g., from signal TP output by a throttle position sensor), accelerator pedal position (e.g., signal PP output by a pedal position sensor), an exhaust gas air-fuel ratio (e.g., as determined from signal UEGO output by the exhaust gas sensor), engine coolant temperature, a state of the engine, and an ignition state of the vehicle. The state of the engine may refer to whether the engine is on (e.g., operating at a non-zero speed, with combustion occurring within engine cylinders) or off (e.g., at rest, without combustion occurring in the engine cylinders). The ignition state of the vehicle may refer to a position of an ignition switch. As an example, the ignition switch may be in an "off" position, indicating that the vehicle is off (e.g., powered down, with a vehicle speed of zero), but with an ignition key inserted (e.g., by a vehicle operator), indicating that a vehicle start may soon be requested. As a third example, the vehicle may be on and operating in an electric-only mode, in which an electric machine (e.g., electric machine 152 of FIG. 1) supplies torque to propel the vehicle and the engine is off and does not supply torque to propel the vehicle.

At 204, method 200 includes starting the engine responsive to an engine start request. In one example, the engine is started in response to the vehicle operator switching the ignition switch to an "on" position, such as by turning the ignition key, depressing an ignition button, or requesting an engine start from a remote device (such as a key-fob, smartphone, a tablet, etc.). In another example, the engine is started in response to the vehicle transitioning from the electric-only mode to an engine mode in which combustion occurs in the engine and the vehicle is propelled at least partially by engine-derived torque. For example, the vehicle may be transitioned to the engine mode when a state of charge (SOC) of a system battery (e.g., system battery 58 of FIG. 1) drops below a threshold SOC. The threshold SOC may be a positive, non-zero battery SOC level below which the system battery may not be able to support or execute additional vehicle functions while propelling the vehicle via torque derived from the electric machine. As another example, the vehicle may be transitioned to the engine mode if vehicle operator torque demand rises above a threshold torque. The threshold torque may be a positive, non-zero amount of torque that cannot be met or sustained by the electric machine alone, for example. Starting the engine may include cranking the engine with an electric motor, such as a starter motor or the electric machine. The engine may be cranked at a speed that enables combustion to commence and the engine to maintain momentum during starting, such as a speed in the range of 50-400 RPM, for example.

At 206, it is determined if engine flooding is detected. Additionally or optionally, it may be determined if wet-fouling of cylinder components is detected. Engine flooding may be detected based on one or more of a position of a throttle coupled to an intake passage during the engine start attempt, an output of an exhaust gas sensor coupled to an exhaust passage, and a number of engine starts attempted without combustion occurring in an engine cylinder. For example, engine flooding engine may be indicated (or anticipated) by a wide open throttle (WOT) signal (wherein the throttle is fully open), generated when the vehicle operator depresses the accelerator pedal to its maximum extent, during engine cranking. In some examples, the controller may be configured to reduce or cease fuel injection during cranking in response to the WOT signal, such as by reducing or completely suppressing fuel injection pulses, thereby preventing the spark plugs from becoming coated with fuel. In other examples, a WOT signal during cranking is an indication of wet-fouling of cylinder components. As another example, engine flooding may be inferred by the exhaust gas sensor indicating a rich air-fuel ratio (AFR) during cranking (e.g., an AFR determined from an output of the exhaust gas sensor being less than a threshold AFR, or a richer than stoichiometric sensor output). As still another example, the flooded engine (and ignitor wet-fouling, for example) may be inferred by a lack of engine start after a predetermined or threshold number of engine start attempts have elapsed without combustion occurring in any engine cylinder.

If engine flooding is not detected, such as when the WOT signal is not present during cranking, the determined AFR is not less than the threshold AFR, or the engine starts within the predetermined number of engine start attempts, method 200 proceeds to 208 and includes delivering fuel and providing spark to the engine cylinders to initiate combustion. For example, fuel may be delivered to the engine cylinders by actuating fuel injectors with a nominal fuel pulse-width for an engine start and the given operating conditions. The controller may determine the fuel pulse-width by inputting the operating conditions, including ambient humidity, MAF (as output by a MAF sensor, such as MAF sensor 120 of FIG. 1), the determined AFR, and a desired AFR, into one or more look-up tables, algorithms, and/or maps and output the fuel pulse-width to send to the fuel injectors. Similarly, spark may be provided at a nominal spark timing for the starting operation and the given operating conditions, such as at or near maximum brake torque (MBT) timing. The controller may input the operating conditions (such as engine speed and load, engine coolant temperature, ambient temperature, exhaust temperature, MAP, etc.) into one or more look-up tables, algorithms, and/or maps and output the spark timing. A signal SA sent to an ignition system at the determined spark timing may trigger firing of a laser pulse from the laser ignitor of the engine's laser ignition system (such as laser system 92 of FIG. 1) to ignite the air-fuel mixture. Following 208, method 200 ends.

If engine flooding is detected at 206, method 200 proceeds to 210 and optionally includes notifying the vehicle operator that a drying routine is about to be executed. For example, a message may be displayed to the vehicle operator, such as on a human-machine interface on a dash of the vehicle (e.g., a display device), stating that the drying routine is being executed and not to attempt further engine starts until prompted. With the vehicle operator notified, the vehicle operator may cease further engine start attempts, thereby avoiding potentially draining the system battery.

At 212, method 200 includes disabling fuel delivery and spark. With the engine flooded, delivery of additional fuel may exacerbate the wet-fouling, increase vehicle emissions, degrade an emission control device (e.g., emission control device 70 of FIG. 1), and reduce fuel economy. By disabling fuel delivery, such as by maintaining the fuel injectors disabled, further wet-fouling, emission control device degradation, increased vehicle emissions, and reduced fuel economy may be avoided. When cylinder components are wet-fouled, an ignitor may not be able to produce a spark across the cylinder, and therefore, actuating the spark delivery may be ineffective. Disabling spark in response to an indication of engine flooding may reduce energy consumption and prevent excess cylinder component wear, for example.

At 214, the method includes selecting a first cylinder for performing the drying routine in. That is, the controller may select a first cylinder to dry. For example, the order of drying the cylinders may be based on power balance test results. If engine data indicates that a first set of cylinders produce adequate torque when fired, there may no need to dry those cylinders (or that first set of cylinders may be assigned a lower priority for drying). If engine data indicates that some other cylinders misfire due to a rich air-fuel mixture, these other cylinders may be given a higher priority for drying, and may be dried first. In still another example, the results of on-board fuel injector diagnostics run by a powertrain control module (PCM), indicative of which cylinder's fuel injector is leaky, may be used to determine the order of drying. Therein, if the PCM is able to pinpoint a leaky injector, the cylinder coupled to the leaking fuel injector may be prioritized to dry first. Optionally, following the results of the fuel injector diagnostic, the controller may even proactively dry the cylinder of the identified leaking fuel injector prior to the crank event. In this way, the controller may select a first cylinder to initiate the drying in, and a sequence for subsequent cylinders, based on one or more of a torque output of each cylinder of the engine and an output of an on-board fuel injector diagnostic routine. Specifically, the first cylinder to be dried may be a misfiring cylinder and/or may have a leaking fuel injector.

In still other examples, the cylinder selection may be based on engine firing order (e.g., the cylinder which will be the first to fire on the subsequent engine restart may be selected). As yet another example, the cylinder selection may be based on cylinder piston position. For example, a cylinder that is in or closest to the exhaust stroke may be selected as the first cylinder. Alternatively, cylinders may be dried in a predefined drying order.

At 216, the method includes spinning the engine, unfueled, via a motor, such as an electric starter motor, or an electric machine of the hybrid vehicle's driveline. Spinning the engine includes spinning the engine in a forward direction, in the same direction of rotation as engine rotation during engine cranking and fueled engine rotation. The engine may be spun at a speed that is low enough to slowly park the engine in a position where the intake valve of the selected cylinder is closed and the exhaust valve is open. For example, the engine may be spun at a speed lower than the engine cranking speed. In one example, the engine may be spun unfueled via the motor at a speed of 300 RPM until the cylinder piston is in a position where the timing angle is around the top (or TDC) of an exhaust stroke.

Figure 3:
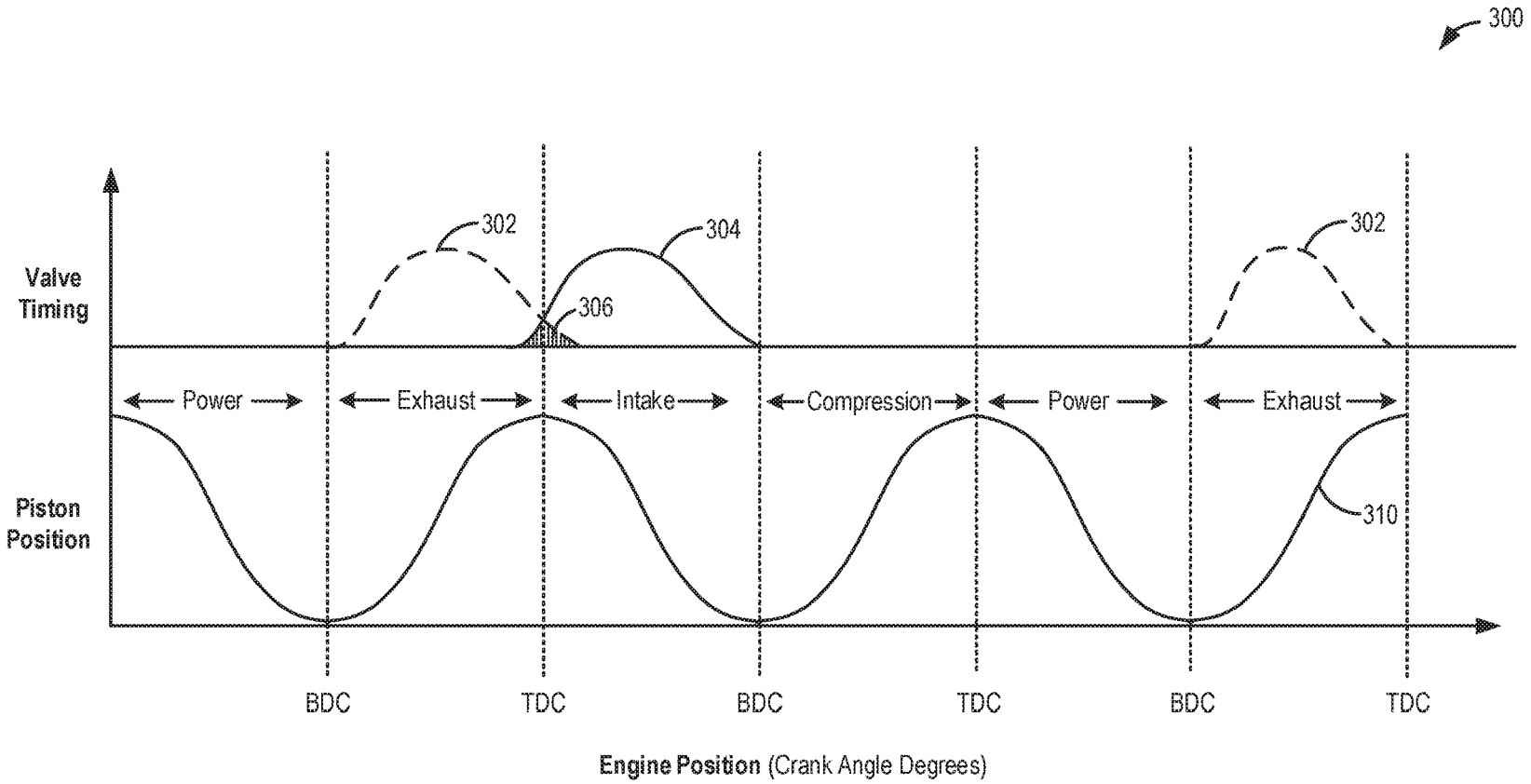
FIG. 3 shows an example map for selecting a cylinder position where laser-based cylinder drying is initiated.

In one example, the controller may refer to a map, such as example map 300 of FIG. 3, to select the timing angle. Turning briefly to FIG. 3, map 300 depicts valve timing and piston position, with respect to an engine position, for a given engine cylinder. Map 300 illustrates an engine position along the x-axis in crank angle degrees (CAD). Curve 310 depicts piston positions (along the y-axis), with reference to their location from top dead center (TDC) and/or bottom dead center (BDC), and further with reference to their location within the four strokes (intake, compression, power and exhaust) of an engine cycle. As indicated by sinusoidal curve 310, a piston gradually moves downward from TDC, bottoming out at BDC by the end of the power stroke. The piston then returns to the top, at TDC, by the end of the exhaust stroke. The piston then again moves back down, towards BDC, during the intake stroke, returning to its original top position at TDC by the end of the compression stroke.

Curves 302 and 304 depict valve timings for an exhaust valve (dashed curve 302) and an intake valve (solid curve 304) during engine operation. As illustrated, an exhaust valve may be opened just as the piston bottoms out at the end of the power stroke. The exhaust valve may then close as the piston completes the exhaust stroke. In the same way, an intake valve may be opened at or before the start of an intake stroke, and may close just as the piston bottoms out at the end of the intake stroke. As a result of the timing differences between exhaust valve closing and intake valve opening, for a short duration depicted herein at 306, around exhaust stroke TDC, including before the end of the exhaust stroke and after the commencement of the intake stroke, both intake and exhaust valves of the given cylinder may be open. This period, during which both valves may be open is referred to as a positive intake to exhaust valve overlap 306 (or simply, positive valve overlap).

During a laser-based drying routine, the controller may spin the engine unfueled to a position where a cylinder that is being diagnosed is at a position in the exhaust stroke, but outside the region of positive valve overlap 306. For example, the engine may be spun to a position just before exhaust stroke TDC, outside the region of positive valve overlap. At this position, the intake valve is closed and the exhaust valve is open. Consequently, heat generated in the cylinder via the laser can be used to vaporize liquid fuel, and the fuel vapors can be directed out of the cylinder into the exhaust passage via the open exhaust valve.

Returning to FIG. 2, at 218, the method includes operating the laser ignition device of the selected cylinder for a duration to generate heat. The laser ignition device is operated at the higher (or highest) power intensity, normally used for initiating cylinder combustion. The duration of operation may be adjusted based on an estimated degree of flooding, the duration increased as the degree of flooding increases. Alternatively, the laser ignition device may be operated for a fixed predefined duration, such as for 3 minutes.

The engine controller may also adjust a location where the laser beam is focused, including a beam direction and a focal point of the beam. In one example, where the laser is maneuverable, the laser beam may be focused on different regions of the cylinder, in random directions, so as to strike all areas of the cylinder. Alternatively, the laser beam may be directed towards cylinder walls. The heat energy generated by the laser operation vaporizes the liquid fuel. Due to the exhaust valve being open and the intake valve being closed, fuel vapors generated by the operation of the laser are then forced out of the cylinder and into the exhaust passage. Consequently, the cylinder and wet-fouled spark plug are dried without requiring any component to be removed from the cylinder. Operating the laser for the duration may include the controller sending a duty cycle or pulse-width signal to the laser exciter to operate the laser at its highest power setting for the defined duration. After the duration of operation, the laser is disabled.

At 220, it is determined if all engine cylinders have been sufficiently dried. For example, it is determined if the drying operation elaborated at 216-218 has been performed in all engine cylinders (or the engine cylinders that were selected for drying, which may be a subset of all the engine cylinders). If not, then at 222, the method includes selecting a next cylinder (e.g., a second cylinder) to perform the drying routine in. The method then returns to 216 to rotate the engine, unfueled via the motor, to a position where the selected cylinder is parked with the intake valve closed and the exhaust valve open. Then, the method moves to 218 to operate the laser in the selected cylinder to vaporize and liquid fuel and dry the cylinder. In this way, the controller may move through multiple iterations of steps 216-222 until all engine cylinders (or at least all selected engine cylinders) have been dried.

At 224, once all engine cylinders have been dried, the method includes enabling fuel delivery and spark to the engine. Enabling fuel delivery and spark may include actuating a fuel pump to provide fuel to fuel injectors at a high pressure. However, the fuel injectors may not yet be actuated open. In this way, fuel may be readied for injection in response to an engine start request, such as an engine start request from the vehicle operator. Similarly, enabling spark may include enabling a spark advance signal to be transmitted from the controller to the laser ignition system in anticipation of the engine start request but not yet transmitting the signal. By enabling fuel delivery and spark, combustion may be initiated in the engine cylinders in response to the engine start request.

At 226, method 200 optionally includes notifying the vehicle operator that an engine start may be attempted. For example, a message may be displayed to the vehicle operator, such as on the human-machine interface (e.g. display device) on the dash of the vehicle, stating that an engine start may be attempted. Then, based on operator input, after the engine has been dried, another engine start attempt may be performed. Following 226, method 200 ends.

Figure 4:
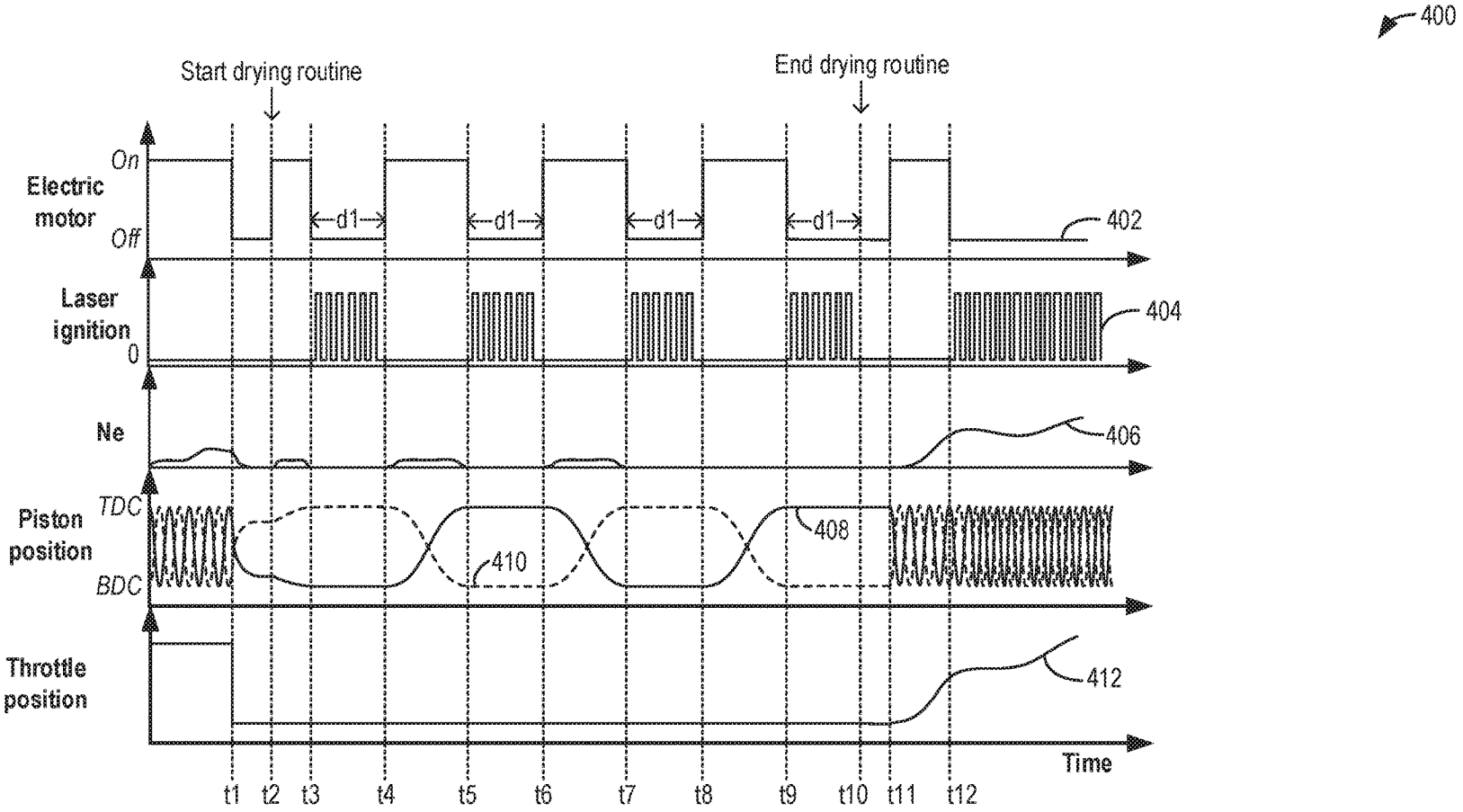
FIG. 4 shows a prophetic example of drying a flooded engine cylinder with heat generated by a laser ignition system.

Turning now to FIG. 4, a prophetic example timeline 400 for drying a flooded engine, and any wet-fouled cylinder components, via laser generated heat is shown. In one example, the engine flooding may be detected and addressed using laser operation according to the example method of FIG. 2.

Timeline 400 depicts an activation state of an electric motor at plot 402, laser ignition operation is shown at plot 404, engine rotation speed (Ne) is shown at plot 406, a piston position of a first cylinder is shown at plot 410 (dashed line), a piston position of a second cylinder is shown at plot 408 (solid line), and a position of an intake throttle (e.g., throttle 72 of FIG. 1) is shown at plot 412. For all of the above, the horizontal axis represents time, with time increasing along the horizontal axis from left to right. The vertical axis represents each labeled parameter. In plots 402 and 404, the vertical axis represents whether the electric motor and laser ignition device, respectively, are "on" (e.g., actively operating, with a non-zero voltage supplied) or "off" (e.g., deactivated and not operating, with no voltage supplied). In plots 406 and 412, the vertical axis represents, respectively, an amount of increase or decrease of engine speed and throttle opening. For plots 408 and 410, the vertical axis shows the piston position from bottom dead center ("BDC") to top dead center ("TDC").

Prior to time t1, the electric motor is on (plot 402) to rotate a crankshaft of the engine in response to an engine start request from a vehicle operator. In one example, the electric motor is a starter motor. In another example, the electric motor is an electric machine included in a hybrid vehicle (e.g., electric machine 152 of FIG. 1). As the engine is rotated (e.g., cranked), a piston within each cylinder of the engine travels between BDC and TDC. For example, for each 360 degree rotation of the crankshaft, the piston may travel from BDC to TDC and back to TDC. The piston of the first cylinder (plot 410) is 180 degrees out of phase of the second cylinder (plot 408) such that the piston of the first cylinder is at TDC when the piston of the second cylinder is at BDC (and vice versa). For example, the engine may be an inline-four cylinder engine. During the cranking, the throttle is fully open (plot 412), such as due to the vehicle operator fully depressing an accelerator pedal. As a result, the engine is flooded. Due to the engine flooding, the engine does not start, and the start attempt ceases at time t1 when the electric motor is deactivated. After the electric motor is deactivated and no longer spins the engine crankshaft, the pistons may briefly continue to move due to momentum before coming to a rest between time t1 and time t2. Also at t1, responsive to the failed engine start attempt, the throttle is closed by a controller (e.g., controller 12 of FIG. 1).

At time t2, in response to the engine flooding condition (e.g., as determined based on the throttle position, an output of an exhaust gas sensor, and/or the engine not starting), the controller initiates an engine drying routine, such as the routine of FIG. 2. Therein, the electric motor is activated at t2, and between t2 and t3, the engine is rotated, slowly (e.g., at 300 RPM) and unfueled, via the motor, until the first cylinder is at a position where the intake valve is closed and the exhaust valve is open. For example, the engine is rotated until the first cylinder is parked at TDC of exhaust stroke, and then the motor is deactivated and further engine rotation is stopped.

After parking the first cylinder at the selected position, between t3 and t4, the laser ignition device of the first cylinder is operated at a high power setting for a duration dl. By operating the laser ignition device, heat is generated in the first cylinder. The heating of the first cylinder causes the liquid fuel in the cylinder to vaporize, drying the cylinder and any wet-fouled components therein.

At t4, after the first cylinder has been dried, the electric motor is reactivated and the engine is rotated, slowly and unfueled, via the motor, until at t5, the second cylinder is at a position where the intake valve is closed and the exhaust valve is open. For example, the engine is rotated until the second cylinder is parked at TDC of exhaust stroke, and then the motor is deactivated and further engine rotation is stopped. After parking the second cylinder at the selected position, between t5 and t6, the laser ignition device of the second cylinder is operated at the high power setting for the duration dl. By operating the laser ignition device, heat is generated in the second cylinder. The heating of the second cylinder causes the liquid fuel in the cylinder to vaporize, drying the cylinder and any wet-fouled components therein.

In the same way, the controller continues to use the motor to sequentially position a third cylinder (between t6 and t7) and then a fourth cylinder (between t8 and t9) at exhaust stroke TDC and operate a laser ignition device of the cylinder to vaporize fuel and dry the cylinder (the third cylinder dried via laser operation between t7 and t8, the fourth cylinder dried via laser operation between t9 and t10). In this way, the flooded engine may be dried cylinder-by-cylinder by indexing the engine. As such, this decreases the battery SOC but to a lesser extent than if the flooded engine were continuously spun via the electric motor.

At t10, all engine cylinders are dried and the vehicle operator is notified that they may resume attempting an engine start. At t11, responsive to the notification, the operator requests an engine start (such as by actuating an engine ignition button or by inserting a key into the ignition, etc.). The intake throttle opening is increased in correlation with the engine start request, such as based on the operator actuation of an accelerator pedal. Between t11 and t12, the engine is cranked via the motor, the engine speed increasing to a cranking speed. At t12, once the engine is successfully cranked, the motor is deactivated and engine fueling and spark is resumed. In this example, cylinder ignition is provided via the laser ignition device. After t12, engine rotation is supported via fueled engine combustion and engine torque produced via the combustion.

In this way, as shown in the example of FIG. 4, an engine controller may indicate flooding of an engine responsive to one or more of intake throttle position and exhaust gas sensor output during a failed engine start attempt. Then, responsive to the indication, disabling engine fueling, and sequentially drying each engine cylinder via operation of a corresponding cylinder laser ignition device while the engine is at rest; and after the drying, reattempting an engine start. In one example, the sequentially drying includes rotating the engine, unfueled via an electric machine, to a position where one-by-one, each cylinder is held at rest with an intake valve closed and an exhaust valve open, and operating the corresponding cylinder laser ignition device for a duration while the cylinder is in the position. The position may include an end of an exhaust stroke of the cylinder, outside of a region of positive intake to exhaust valve overlap. Herein, the indicating may be responsive to one or more of a wide open intake throttle position and a lower than threshold exhaust gas sensor output. Further, the reattempted engine start is a successful engine start.

In this way, in response to a determination of engine flooding and wet-fouling of in-cylinder components of an engine system, the one or more cylinders of the flooded engine may be dried via operation of a laser ignition device while the in-cylinder components remain in the engine. The technical effect of providing heat directly into the cylinder via laser ignition operation is that vaporization of liquid fuel from a flooded engine is expedited without requiring additional hardware or requiring any component to be removed from an engine cylinder. In addition, an amount of time before the engine can be started is decreased, thereby decreasing vehicle operator frustration and an amount of battery power that is consumed on the engine start. By drying each cylinder sequentially, while the engine is at rest, an amount of time elapsed before the flooded engine can be restarted is reduced. In this way, sufficient battery may remain for starting the engine and operating the vehicle after the engine is dried. By mitigating engine flooding and cylinder component wet-fouling, and rapidly drying the cylinders while all the in-cylinder components remain in the engine, an amount of emissions from the flooded engine can also be reduced.

One example method for an engine comprises: in response to flooding of an engine with fuel during an engine start attempt, shutting off fuel delivery to an engine cylinder and operating a laser ignition device to vaporize the fuel while holding an exhaust valve of the cylinder open and an intake valve of the cylinder closed. In the preceding example, additionally or optionally, the method further comprises rotating the engine, unfueled via an electrically actuated motor, to a position where the exhaust valve of the cylinder is open and the intake valve of the cylinder is closed, the position including top dead center of an exhaust stroke of the cylinder, the engine rotated at a speed lower than engine cranking speed. In any or all of the preceding examples, additionally or optionally, the laser ignition device is operated for a duration based on a degree of the flooding of the engine, the duration increased as the degree of the flooding increases. In any or all of the preceding examples, additionally or optionally, the cylinder is a first cylinder, the method further comprising sequentially operating the laser ignition device coupled to each remaining cylinder of the engine to dry the engine. In any or all of the preceding examples, additionally or optionally, the method further comprises, after drying the engine, performing another engine start attempt. In any or all of the preceding examples, additionally or optionally, the method further comprises selecting the first cylinder and an order of the sequentially operating the laser ignition device coupled to each remaining cylinder of the engine based on one or more of torque output of each cylinder of the engine, and output of on-board fuel injector diagnostic routine. In any or all of the preceding examples, additionally or optionally, the first cylinder is a misfiring cylinder and/or has a leaking fuel injector. In any or all of the preceding examples, additionally or optionally, the method further comprises flowing the vaporized fuel out of the cylinder and into an exhaust passage via the open exhaust valve. In any or all of the preceding examples, additionally or optionally, the engine includes an intake passage having a throttle coupled therein and an exhaust passage with an exhaust sensor coupled thereto, the method further comprising indicating the flooding of the engine based on at least one of a position of the throttle during the engine start attempt, an output of the exhaust gas sensor during the engine start attempt, and a threshold number of engine start attempts being reached without combustion occurring in the cylinder. In any or all of the preceding examples, additionally or optionally, indicating based on the position of the throttle includes indicating flooding of the engine based on the throttle being fully open during the engine start attempt, and wherein indicating based on the output of the exhaust gas sensor includes indicating flooding of the engine based on a richer than stoichiometric output of the exhaust gas sensor.

Another example method comprises: indicating flooding of an engine responsive to one or more of intake throttle position and exhaust gas sensor output during a failed engine start attempt; responsive to the indication, disabling engine fueling, and sequentially drying each engine cylinder via operation of a corresponding cylinder laser ignition device while the engine is at rest; and after the drying, reattempting an engine start. In the preceding example, additionally or optionally, the sequentially drying includes rotating the engine, unfueled via an electric machine, to a position where one-by-one, each cylinder is held at rest with an intake valve closed and an exhaust valve open, and operating the corresponding cylinder laser ignition device for a duration while the cylinder is in the position. In any or all of the preceding examples, additionally or optionally, the position includes an end of an exhaust stroke of the cylinder, outside of a region of positive intake to exhaust valve overlap. In any or all of the preceding examples, additionally or optionally, the indicating is responsive to one or more of a wide open intake throttle position and a lower than threshold exhaust gas sensor output. In any or all of the preceding examples, additionally or optionally, the reattempted engine start is a successful engine start.

Another example vehicle system comprises an engine including a plurality of cylinders, each of the plurality of cylinders including a corresponding laser ignition device, and fuel injector; an intake passage including an intake throttle, the throttle coupled to a throttle position sensor; an exhaust passage including an exhaust gas air-fuel ratio sensor; an electric motor; and a controller with computer readable instructions stored on non-transitory memory for: responsive to an unsuccessful engine start attempt, indicating engine flooding based on intake throttle position and air-fuel ratio sensor output during the unsuccessful engine start attempt; and responsive to the indication of engine flooding, disabling engine fueling, and sequentially drying each of the plurality of cylinders via operation of the laser ignition device while holding a corresponding cylinder at an exhaust stroke TDC position. In the preceding example, additionally or optionally, holding the corresponding cylinder at an exhaust stroke TDC position includes rotating the unfueled engine via the electric motor to sequentially hold the corresponding cylinder at the exhaust stroke TDC position. In any or all of the preceding examples, additionally or optionally, the electric motor is one of a starter motor coupled to the engine, and a propulsion motor coupled a driveline of the vehicle system, and wherein operating the laser ignition device includes operating at a higher power setting than used for piston position determination. In any or all of the preceding examples, additionally or optionally, the sequentially drying includes selecting a sequence for drying each of the plurality of cylinders based on one or more of cylinder misfire count, output from a fuel injector diagnostic routine, a first cylinder of the plurality of cylinders selected to be earlier in the sequence responsive to a higher misfire count and/or indication of a leaking fuel injector of the first cylinder, a second cylinder of the plurality of cylinder selected to be later in the sequence responsive to a lower misfire count and/or indication of a functional fuel injector of the second cylinder. In a further representation, the vehicle system is a hybrid vehicle system.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

in response to flooding of an engine with fuel, sensed during an engine start attempt via sensors and a controller, shutting off fuel delivery to an engine cylinder and operating a laser ignition device of the cylinder to vaporize the fuel while holding an exhaust valve of the cylinder open and an intake valve of the cylinder closed.

2. The method of claim 1, further comprising rotating the engine, unfueled via an electrically actuated motor, to a position where the exhaust valve of the cylinder is open and the intake valve of the cylinder is closed, the position including top dead center of an exhaust stroke of the cylinder, the engine rotated at a speed lower than engine cranking speed.

3. The method of claim 1, wherein the laser ignition device is operated for a duration based on a degree of the flooding of the engine, the duration increased as the degree of the flooding increases.

4. The method of claim 1, wherein the cylinder is a first cylinder, the method further comprising sequentially operating a corresponding laser ignition device coupled to each remaining cylinder of the engine to dry the engine.

5. The method of claim 4, further comprising, after drying the engine, performing another engine start attempt.

6. The method of claim 4, further comprising selecting the first cylinder and an order of the sequentially operating the corresponding laser ignition device coupled to each remaining cylinder of the engine based on one or more of a torque output of each cylinder of the engine, and output of an on-board fuel injector diagnostic routine.

7. The method of claim 6, wherein the first cylinder is a misfiring cylinder and/or has a leaking fuel injector.

8. The method of claim 1, further comprising flowing the vaporized fuel out of the cylinder and into an exhaust passage via the open exhaust valve.

9. The method of claim 1, wherein the engine includes an intake passage having a throttle coupled therein and an exhaust passage with an exhaust sensor coupled thereto, the method further comprising indicating the flooding of the engine based on at least one of a position of the throttle during the engine start attempt, an output of the exhaust sensor during the engine start attempt, and a threshold number of engine start attempts being reached without combustion occurring in the cylinder.

10. The method of claim 9, wherein indicating based on the position of the throttle includes indicating flooding of the engine based on the throttle being fully open during the engine start attempt, and wherein indicating based on the output of the exhaust sensor includes indicating flooding of the engine based on a richer than stoichiometric output of the exhaust sensor.

11. A method, comprising:

indicating flooding of an engine responsive to one or more of intake throttle position and exhaust gas sensor output during a failed engine start attempt;

responsive to the indication, via an engine controller, disabling engine fueling and sequentially drying each engine cylinder via operation of a corresponding cylinder laser ignition device while the engine is at rest; and after the drying, reattempting an engine start.

12. The method of claim 11, wherein the sequentially drying includes rotating the engine, unfueled via an electric machine, to a position where one-by-one each cylinder is held at rest with an intake valve closed and an exhaust valve open, and operating the corresponding cylinder laser ignition device for a duration while the cylinder is in the position.

13. The method of claim 12, wherein the position includes an end of an exhaust stroke of the cylinder, outside of a region of positive intake to exhaust valve overlap.

14. The method of claim 11, wherein the indicating is responsive to one or more of a wide open intake throttle position and a lower than threshold exhaust gas sensor output.

15. The method of claim 11, wherein the reattempted engine start is a successful engine start.

16. A vehicle system, comprising:

an engine including a plurality of cylinders, each of the plurality of cylinders including a corresponding laser ignition device and a fuel injector;

an intake passage including an intake throttle, the throttle coupled to a throttle position sensor;

an exhaust passage including an exhaust gas air-fuel ratio sensor;

an electric motor; and a controller with computer readable instructions stored on non-transitory memory for:

responsive to an unsuccessful engine start attempt, indicating engine flooding based on intake throttle position and air-fuel ratio sensor output during the unsuccessful engine start attempt; and responsive to the indication of engine flooding, disabling engine fueling, and sequentially drying each of the plurality of cylinders via operation of the corresponding laser ignition device while holding a corresponding cylinder at an exhaust stroke TDC position.

17. The system of claim 16, wherein holding the corresponding cylinder at the exhaust stroke TDC position includes rotating the unfueled engine via the electric motor to sequentially hold the corresponding cylinder at the exhaust stroke TDC position.

18. The system of claim 17, wherein the electric motor is one of a starter motor coupled to the engine, and a propulsion motor coupled to a driveline of the vehicle system, and wherein operating each corresponding laser ignition device includes operating at a higher power setting than used for piston position determination.

19. The system of claim 16, wherein the sequentially drying includes selecting a sequence for drying each of the plurality of cylinders based on one or more of cylinder misfire count, output from a fuel injector diagnostic routine, a first cylinder of the plurality of cylinders selected to be earlier in the sequence responsive to a higher misfire count and/or indication of a leaking fuel injector of the first cylinder, a second cylinder of the plurality of cylinder selected to be later in the sequence responsive to a lower misfire count and/or indication of a functional fuel injector of the second cylinder.

20. The system of claim 16, wherein the controller includes further instructions for restarting the engine after drying each of the plurality of cylinders.

* * * * *